United States Patent [19]

Miyazako et al.

[11] 4,131,469

[45] Dec. 26, 1978

[54] PHOTOGRAPHIC ELEMENT WITH POLYMERIC AMMONIUM MORDANT

[75] Inventors: Takushi Miyazako; Shinji Sakaguchi; Sosuke Hanai; Yukio Karino, all of Minami-ashigara, Japan

[73] Assignee: Fuji Photo Film Co., Ltd., Minami-ashigara, Japan

[21] Appl. No.: 829,858

[22] Filed: Sep. 1, 1977

[30] Foreign Application Priority Data

Sep. 1, 1976 [JP] Japan ..... 51-104525

[51] Int. Cl.[2] ..... G03C 1/40; G03C 7/00; G03C 1/84; G03C 1/72

[52] U.S. Cl. ..... 96/77; 96/3; 96/29 D; 96/84A; 96/114

[58] Field of Search ..... 96/3, 29 D, 77, 114, 96/84 A

[56] References Cited

U.S. PATENT DOCUMENTS

| | | | |
|---|---|---|---|
| 3,770,439 | 11/1973 | Taylor | 96/77 |
| 3,944,424 | 3/1976 | Cohen et al. | 96/77 |

*Primary Examiner*—Richard C. Schilling

*Attorney, Agent, or Firm*—Sughrue, Rothwell, Mion, Zinn and Macpeak

[57] ABSTRACT

A dye mordant composition containing a polymer comprising repeating units with at least 20 mol % of the repeating units having the general formula (I):

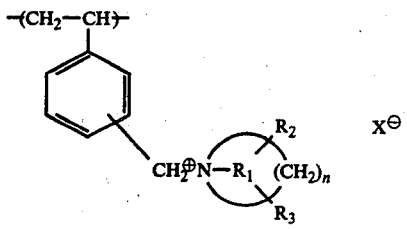

(I)

wherein $R_1$ represents an alkyl group containing 1 to 12 carbon atoms, an aralkyl group, an aryl group or an allyl group; $R_2$ and $R_3$, which may be the same or different, each represents a hydrogen atom, an alkyl group, an aralkyl group, an aryl group or an allyl group, where the total number of carbon atoms contained in the main chain and/or ring of $R_2$ and $R_3$ is less than 16; $n$ represents an integer from 2 to 20; and $X^{\ominus}$ represents an anion.

12 Claims, No Drawings

PHOTOGRAPHIC ELEMENT WITH POLYMERIC AMMONIUM MORDANT

BACKGROUND OF THE INVENTION

1. Field of the Invention

The present invention relates to a dye mordant composition containing a certain polymer compound useful in a silver halide photographic element.

2. Description of the Prior Art

It is well known in the photographic art that various kinds of polymer materials and mordants can be employed with the intention of preventing dyes from diffusing in a color image transfer element which comprises a support and a silver halide emulsion-containing layer. Image receiving elements containing mordants are described in, for example, U.S. Pat. Nos. 2,584,080 and 3,770,439. Certain, water-insoluble mordant polymers have already been produced as disclosed in U.S. Pat. No. 3,898,088. Mordants of this kind not only have excellent dye retention properties but also have extremely low diffusibility.

The use of these polymers as a mordant is accompanied by the disadvantage that they must be dissolved in a 40% by weight alcohol solution (and generally, in a methanol-water solution). The use of a large quantity of such alcohol solutions causes difficulties in that not only must extra expense be borne in order to eliminate the alcohols contained therein, but also another, different kind of coating process e.g., a coating process using a solution thereof in an organic solvent such as methanol, ethanol, etc. is required. In addition, it is difficult to form a homogeneous and uniform coating using conventional coating compositions because of the high viscosity of the coating composition containing such.

Further, the application of mordant polymers of this kind to an image receiving layer in the diffusion transfer process gives rise to a serious problem called the "after-transfer" phenomena, which term is used herein to describe the increase with the passage of time in the density of the transferred dye image beyond that necessary with the balance between the color densities of the image being destroyed.

On the other hand, mordant polymers which are disclosed in Japanese Patent Application (OPI) No. 71332/75 (corresponding to U.S. Patent Application Ser. No. 517,561, filed Oct. 24, 1974) do not give rise to the after-transfer phenomena, but a demordanting phenomena in a low pH range, e.g., about 2 to about 8, occurs to result in a reduction in the quality of the image due to the fading of the transferred dye image. Furthermore, when the mordant polymers used are hydrophilic, they have an additional disadvantage in that they diffuse into other layers because of their water soluble property in photographic layers.

As used herein, the term "demordanting phenomena" means the gradual decrease in the density of the transferred dye image with the passage of time.

Many investigations have been undertaken with the intention of discovering mordant polymers which are capable of strongly mordanting dyes, which are essentially non-diffusible and with which the after-transfer phenomena does not occur.

SUMMARY OF THE INVENTION

Therefore, an object of the present invention is to provide a novel dye mordant composition which can exert an excellent mordanting effect upon acidic dyes and with which an after-transfer phenomenon does not occur.

Another object of the present invention is to provide a novel process for preparing photographic elements containing polymer mordants which can be coated in a form of solution containing a reduced amount of an organic solvent.

A further object of the present invention is to provide photographic elements which comprises at least one support, at least one silver halide emulsion layer and at least one layer of a mordant composition.

Still another object of the present invention is to provide an image receiving element for a color diffusion transfer process which comprises a support and a dye mordant layer.

Another object of the present invention is to provide superposed integral negative image receiving photographic elements containing at least one diffusible dye receiving layer containing a mordant polymer and at least one light sensitive silver halide emulsion layer associated with the respective dye image-providing materials.

Still another object of the present invention is to provide diffusion-transfer, integral image-receiving, photographic elements comprising a support having thereon at least one dye receiving layer containing a mordant polymer and at least one layer containing a silver halide photographic emulsion associated with the respective dye image-providing materials.

In accordance with one embodiment of the present invention, mordant polymers which are capable of fixing acidic dyes sufficiently and with which substantially no after-transfer phenomena occur are provided which comprise at least one polymer containing repeating units with at least 20 mol % of the repeating units being represented by the following general formula:

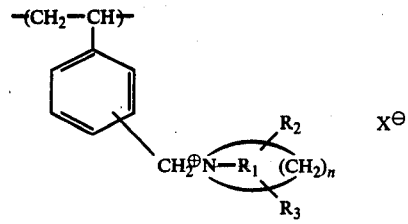

(I)

wherein $R_1$ represents an alkyl group containing 1 to 12 carbon atoms (including a substituted alkyl group) (e.g., methyl, ethyl, propyl, butyl, hexyl, octyl, lauryl, ethoxypropyl, phenoxyethyl, etc.); an aralkyl group (e.g., having 7 to 10 carbon atoms in which the aryl moiety thereof may be substituted with an alkyl group having 1 to 3 carbon atoms such as benzyl, phenethyl, phenylpropyl, etc.); an aryl group (e.g., having 6 to 12 carbon atoms such as phenyl, naphthyl, etc.); or an allyl group: $R_2$ and $R_3$ each represents a hydrogen atom, an alkyl group (e.g., having 1 to 8 carbon atoms such as methyl, ethyl, propyl, butyl, hexyl, octyl, lauryl, etc.), an aralkyl group (e.g., having 1 to 10 carbon atoms in which the aryl moiety may be substituted with an alkyl group having 1 to 3 carbon atoms such as benzyl, phenethyl, phenylpropyl, etc.), an aryl group (e.g., having 6 to 12 carbon atoms such as phenyl, naphthyl, etc.) or an allyl group, wherein the total number of carbon atoms present in the main chain and/or ring of $R_2$ and $R_3$ is less than 16; n represents an integer from 2 to 20; and $X^{\ominus}$ represents a photographically inert anion (e.g., bromide, chloride, sulfate, p-toluenesulfonate, etc.).

DETAILED DESCRIPTION OF THE INVENTION

A preferred polymer employed in the present invention should contain at least 20 mol % of the above-described repeating units of the general formula (I) therein, and they may be a homopolymer or a copolymer. Suitable copolymers may contain $\alpha,\beta$-ethylenically unsaturated monomer units, other than the above-described repeating unit, copolymerizable therewith. Examples of suitable copolymerizable monomers include ethylene, propylene, isobutene, diisobutylene, styrene, $\alpha$-methylstyrene, vinyltoluene, vinyl acetate, acrylonitrile, acrylamide, N-vinyl pyrrolidone, vinyl chloride, vinylidene chloride, methacrylic acid esters or acrylic acid esters (e.g., methylmethacrylate, methylacrylate, ethylacrylate, butylmethacrylate, butylacrylate, 2-ethylhexylmethacrylate, hydroxyethylacrylate, benzylmethacrylate, cyclohexylmethacrylate, allylmethacrylate, etc.), divinylbenzene, ethylene glycol dimethacrylate, methylenebisacrylamide and so on, preferably, styrene, vinyltoluene, methylmethacrylate, butylacrylate, benzylmethacrylate, particularly preferably styrene and vinyltoluene.

Polymers employed in the present invention can be prepared through homopolymerization of chloromethylstyrene or copolymerization together with other vinyl monomers by subjecting the monomers to a homo- or co-polymerizing reaction, respectively, to produce polymers, and then reacting the resulting polymer with N-alkylpolymethyleneimines. In another process, chloromethylstyrene and N-alkylpolymethyleneimines are first reacted with each other to produce quaternary salts of vinyl monomers and then, the resulting quaternary salt monomers are polymerized independently or copolymerized together with other vinyl monomers to prepare mordant polymers.

Suitable N-alkylpolymethylene imines which can be employed for the preparation of the mordants of the present invention are represented by the following general formula (II):

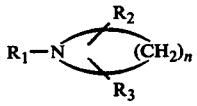

(II)

wherein $R_1$, $R_2$, $R_3$ and n each has the same meaning as in the above-described general formula (I) of the repeating unit present in the polymers used in this invention; $R_1$ is preferably an alkyl group or an aralkyl group.

Since mordanting capability towards dyes is reduced when the N-alkylpolymethyleneimines used have too low a molecular weight and when the N-alkylpolymethyleneimines have too a high molecular weight, the preparation of thereof becomes difficult; most preferable N-alkylpolymethylenemines are those where n = 5–16.

Preferred examples of N-alkylpolymethylenemines which can be used include N-benzylpiperidine, N-2-ethylhexylpiperidine, N-tert-amyl-hexamethyleneimine, 2,6-dimethyl-N-hexylpiperidine, diphenyl-N-methylethyleneimine, N-benzyloctamethyleneimine, N-phenethyloctamethyleneimine, N-methyldodecamethyleneimine, N-benzyldodecamethyleneimine, N-hexyldodecamethyleneimine, 4-ethyl-N-2,6-dimethyl-4-heptylpiperidine, N-isopropylbenzylhexamethyleneimine and the like.

The mordant polymers employed in the present invention can be prepared using any conventional radical polymerization technique such as solution polymerization, bulk polymerization and emulsion polymerization. A preferred temperature for polymerization ranges from about 20° C. to about 150° C. and, particularly, from 35° C. to 90° C. The time required for the polymerization generally ranges from about 6 to about 120 hours and preferably, from 8 to 24 hours. When a chloromethylstyrene homopolymer or copolymer is reacted with the N-alkylpolymethyleneimine to prepare the corresponding quaternary salt polymer, preferred solvents used therein include dimethylformamide, acetonitrile, methanol, ethanol, ethyl Cellosolve, methyl Cellosolve, water and the like. The above-described repeating unit must be present in the thus-obtained quaternary salt polymers in a proportion of at least 20 mol % and preferably, more than 35 mol %. The above-described reaction is carried out at temperatures ranging from about 50° C. to about 100° C. at reaction times ranging from about 2 to about 120 hours and particularly, from 6 to 12 hours. Preferred molecular weights of the mordant polymers of the present invention range from about 5,000 to about 1,000,000 and particularly, from 10,000 to 200,000.

Specifically, suitable polymers which can be used as a mordant in the present invention include those which contain the following repeating units, wherein the above-described repeating units are present in the polymer in proportions of at least about 20 mol %:

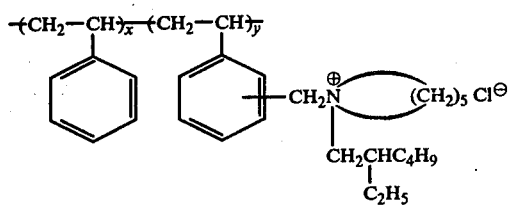

Polymer 1

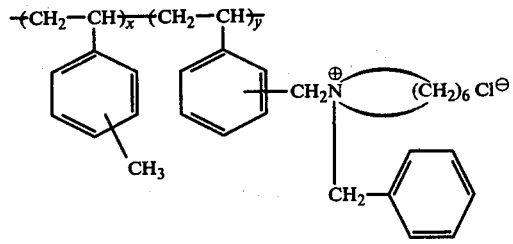

Polymer 2

-continued

Polymer 3

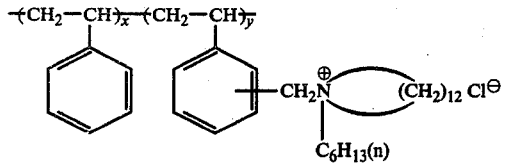

Polymer 4

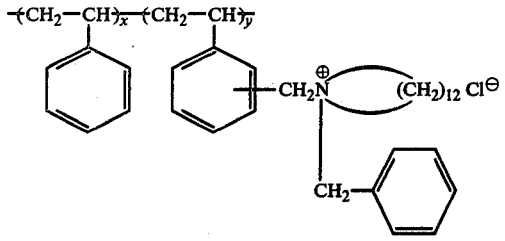

Polymer 5

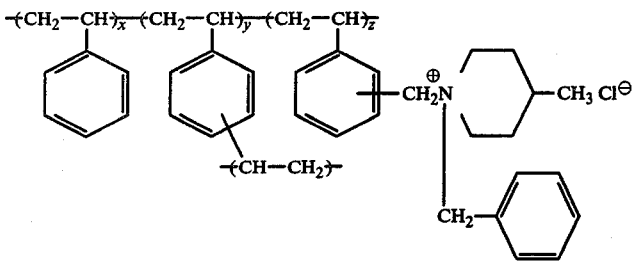

wherein X, y and z represents respectively the molar ratios of the units indicated and $x+y+z=100$.

Various kinds of additives can be added to the layer of the mordant polymer employed in the present invention. Examples of such additives include ultraviolet light absorbing agents such as substituted-2-hydroxyphenylbenzotriazoles (commercially available as "Tinuvin", tradename produced by Ciba-Geigy Corporation), hydroxybenzophenone and the like, and antioxidants such as tert-butylhydroxyanisole, substituted chromanols and so on.

Dye mordant compositions are useful for the preparation of photographic elements comprising a support, at least one layer thereon containing the dye mordant and at least one layer containing an acidic dye or a precursor thereof.

Examples of suitable supports which can be employed herein include any conventional photographic support materials such as paper, baryta paper, resin coated paper, pigment coated polymer films, a polyethylene terephthalate film, a cellulose acetate film, glass, grained aluminum, polycarbonate film and so on. Examples of these support materials are described in *Product Licensing Index,* Vol. 92 Publication 9232, page 107–110 (Dec. 1971). Also, supports may comprise any one of the above-described support materials, sometimes with a timing layer, an overcoat layer, an acidic layer and so on thereon. These supports are coated with substantially aqueous dispersions of the polymers employed in the present invention and then, covered with layers containing acidic dyes or the precursors thereof (whereon multiple layers may be coated).

In accordance with preferred embodiments of the present invention, image transfer film units are provided which comprise the following elements:

(1) a photographic element comprising a support with at least one layer containing a dye image-providing material and a silver halide emulsion provided on the support, (2) an image receiving element comprising an image receiving layer containing the above-described mordant, and (3) means containing an alkaline composition adapted to discharge its contents thereof within the film unit.

The term "substantially aqueous" as used above means that at least about 90% by weight, and preferably at least 95% by weight, of water is contained in the carrier portion of a dispersion. The remainder of the carrier of a dispersion comprises water-miscible organic solvents such as methanol, ethanol, isopropanol, 2-methoxyethanol and/or other alcohols.

Acidic dyes (anionic dyes) and precursors thereof which are received by the dye mordants employable in the present invention are well-known compounds in this art. Dyes of this kind have acidic groups such as carboxylic acid, sulfonic acid, ionizable sulfonamide, or aromatic or heterocyclic groups substituted with hydroxy groups. Precursors of acidic dyes are described in U.S. Pat. No. 3,880,658. Typical examples of dyes which can be received by the dye mordants of the present invention are preformed dyes such as those disclosed in Belgian Pat. Nos. 788,268; 796,040; 796,041 and 796,042; and U.S. Pat. No. 3,443,939; for example, Anthracene Yellow Gr (400% Pure Schultz No. 177), Fast Fed S. Conc. (Color Index 176), Pontacyl Green SN Ex. (Color Index 737), Acid Blue Black (Color Index 246), Acid Magenta O (Color Index 692), Naphthol Green B Conc. (Color Index 5), Brilliant Paper Yellow Ex. Conc. 125% (Color Index 364), Tartrazine (Color Index 640), Metanil Yellow Conc. (Color Index 138), Pontacyl Carmine 6B Ex. Conc. (Color Index 57), Pontacyl Scarlet R Conc. (Color Index 487) and Pontacyl Rubine R Ex. Conc. (Color Index 179): and shifted dyes as disclosed in U.S. Pat. No. 3,854,945.

The amount of the polymer of the present invention necessary for mordanting may be dispersed into a substantially aqueous medium, or added to a hydrophilic organic colloidal binder which is compatible with water. The resulting dispersion or mixture can be used in the preparation of dye imbibition printing blank receiving layers in a color transfer process, which are described in U.S. Pat. Nos. 3,362,819; 2,983,606; 3,227,552 and 3,227,550; and further, in an antihalation layer as disclosed in U.S. Pat. No. 3,282,699. A suitable amount of the polymer of the present invention can range from about 0.5 $g/m^2$ to about 10 $g/m^2$, preferably 1.5 $g/m^2$ to 5 $g/m^2$. The polymer of the present invention is generally used in an amount of about 10 to about 100% by weight, preferably 20 to 50% by weight of the colloidal binder present. Colloids which can provide a satisfactory result when they are employed for the above-described purposes include any hydrophilic colloids generally employed in the photographic art. Specific examples thereof include colloidal albumin, polysaccharides, cellulose derivatives, polyvinyl compounds (including polyvinyl alcohol derivatives), acrylamide polymers and other synthetic polymers.

In general, a dye image receiving element contains a mordant in a mordanting amount and, for example, in other words, a dye mordant layer. The amount of dye mordant to be used is selected depending upon the amount of dyes to be mordanted, the mordanting function inherent in the mordant polymer used and the chemistry of image formation, which can easily be determined by one skilled in the art. The dye image receiving element comprises the mordant polymer of the present invention provided on a support. This element may contain other layers; for example, an acid polymer layer, a timing layer as disclosed in U.S. Pat. Nos. 2,584,030 and 3,362,819; and an interlayer capable of reflecting light which is composed of a white pigment capable of reflecting light such as $TiO_2$ and a binder polymer, as disclosed in U.S. Pat. No. 3,445,228.

The mordant polymers employed in the present invention are also particularly effective when used as a light filtering layer; e.g., anti-halation layers of the type as disclosed in U.S. Pat. No. 3,282,699. This light filtering layer preferably comprises a hydrophilic colloid and the polymer used in the present invention. This layer is suitable for the dyes held or fixed by the mordant.

In one embodiment, the mordants of the present invention are employed in an image transfer film unit with the intention of mordanting image dyes. These mordants can be employed in any of the image transfer film unit formats wherein compounds of the kind which can be originally mobile (e.g., developer dyes) or other compounds of the kind of which are not originally mobile (e.g., diffusible dye-releasing compounds upon oxidation) are incorporated. Typical and useful image transfer formats are described in U.S. Pat. Nos. 2,543,181; 2,983,606; 3,227,550; 3,227,552; 3,415,645; 3,415,644; 3,415,646 and 3,635,707; Canadian Pat. No. 674,082; and Belgian Pat. Nos. 757,959 and 757,960.

In a very advantageous embodiment, the mordants of the present invention are employed in a photographic element of an image transfer film unit wherein a positive image obtained by a processing with a single processing solution is observed through a transparent support with an opaque background.

In another more preferred embodiment, the mordants of the present invention are employed in a color image transfer film unit containing the following elements;

(1) a photographic element wherein at least one layer containing a silver halide emulsion associated with a dye image-providing material (and preferably, three layers which contain a blue-sensitive silver halide emulsion, a green-sensitive silver halide emulsion and a red-sensitive silver halide emulsion, respectively) is coated on a support;

(2) an image receiving layer containing the above-described mordant polymers, which may be coated on another support different from the support used for the photographic element (1), or may be coated in a multi-layer form on the support used for the photographic element (1) having thereon silver halide emulsion layers (which may be single or multiple layers), wherein the layer is preferably positioned adjacent the light sensitive silver halide emulsion layer provided on the same support, and (3) a means capable of releasing an alkaline processing solution into this film unit from a container therefor.

When the image receiving layer is coated on the same support as that which has thereon light sensitive silver halide emulsion layers, the support is preferably transparent. A reflecting layer and an opaque layer may be preferably positioned therein between the image receiving layer and the light sensitive silver halide layer. The alkaline processing composition contains materials which provide opacity such as carbon or the combination of a pH indicator dye with a pigment such as $TiO_2$, and is preferably released into a film unit between a dimensionally stable support or cover sheet and a photographic element.

In one preferred embodiment, this cover sheet is superposed upon the photographic element or designed so as to be superposed thereon. A mordant-containing layer may be positioned upon this cover sheet. In one preferred embodiment wherein a photographic element contains an image receiving layer, a neutralizing layer is provided on this cover sheet.

Means which can be employed for the introduction of an alkaline processing solution into a film unit are known in this art. Examples of such means, include a rupturable container retaining the processing composition which can be ruptured to release the contents at a desired position in the film unit when it is pressed by being passed through a pair of rollers positioned so that the contents of the container may be discharged on the photographic element, frangible containers positioned over or within the photographic element, a hypodermic syringe, and the like.

The term "dye image-providing materials" as used in the present specification means compounds having the following characteristics:

(1) compounds for which certain chemical reactions are not necessary in order to produce dye images, or (2) compounds which undergo reactions encountered in photographic imaging systems to produce an image dye, such as with color couplers, oxichromic compounds and the like. Compounds classified into the first category are generally called preformed image dyes (including shifted dyes), while the other compounds classified into the second category are generally called dye precursors.

The terms "originally mobile" and "originally non-mobile" as used in the present specification mean whether the compounds are substantially mobile or non-mobile when added to a photographic element upon contact with an alkaline processing solution.

In one preferred embodiment wherein a negative silver halide emulsion is employed, originally mobile dye image-providing materials; for example, those materials which have been used in image transfer photographic elements, may be employed. Typical examples of dye image-providing materials effectively used as originally mobile dye-image-providing materials include dye developers as disclosed in U.S. Pat. Nos. 2,983,606 and 3,255,001; oxichromic developers capable of producing dye images when subjected to a color forming oxidation, as disclosed in U.S. Pat. No. 3,880,658; dye developers the dye moieties of which are shifted indophenol dyes, as disclosed in U.S. Pat. No. 3,854,945; and dye developers the dye moieties of which are metallized dyes, as disclosed in U.S. Pat. Nos. 3,482,972; 3,544,545; 3,551,406 and 3,563,739.

In another preferred embodiment wherein negative silver halide emulsions are used, the dye image-providing materials employed are originally non-mobile dye image-providing materials.

Preferred examples of these originally non-mobile dye image-providing materials include non-mobile type compounds employed for photography which can act so as to form a positive distribution, as disclosed in, for example, Belgian Patent 810,195.

In still another embodiment, non-mobile type dye image-providing materials having associated therewith silver halide emulsions are employed, which compounds undergo oxidation followed by hydrolysis as the result of which mobile image dyes with an image-wise distribution are provided. When compounds of this type are employed together with negative type emulsions, a positive image can be formed on the exposed side of a photographic element. Moreover, these compounds having associated therewith direct positive type emulsions or reversal emulsions can be used to produce, for example, positive transferred images in an image transfer film unit. Typical examples of useful compounds of this type include those which are disclosed in, Canadian Pat. No. 602,607; Belgian Pat. No. 788,268; and U.S. Pat. Nos. 3,698,897; 3,728,113; 3,725,062; 3,227,552; 3,443,939; 3,443,940 and 3,443,941.

In one preferred embodiment, mordants having the above-described formula are employed in an image transfer film unit. In this unit, non-mobile type, image dye-providing materials capable of releasing sulfonamido dyes when oxidized are present. Typical examples of useful materials which are oxidized and undergo a hydrophilic cleavage thereof to release sulfonamido dyes are described in Belgian Pat. No. 788,268.

In a further embodiment, the above-described mordants can be employed in an image transfer film unit containing negative type silver halide emulsion-containing layers and further, adjacent layers which contain physical developing nuclei and dye image-providing materials. Typical examples of photographic elements of this type are disclosed in U.S. Pat. No. 3,227,551 column 6 and 7 and British Pat. No. 904,364.

Where a water permeable colloid is used an appropriate amount of the mordant to be added depends upon not only the dyes to be fixed in the mordant layer but also chemical properties of the mordant used. These mordants must be, in general, present in amounts of at least about 10% by weight based the weight of the hydrophilic colloid used. Much larger quantities of mordants may be employed if desired. For example, about 50% by weight or so of mordant (which is represented by taking the weight of the hydrophilic colloid used as a standard) gives rise to a very desirable result.

In addition, these mordants can be employed for not only fixing dyes and particularly, acidic dyes, but also for making a photographic filter layer, an anti-halation layer and a gelatin silver halide emulsion layer. These layers may be applied to a conventionally used photographic support such as a support sheet (e.g., of cellulose acetate, polyesters, polyvinyl resins or like films), paper or glass.

The mordanting polymers of the present invention can be employed as a combination thereof incorporation by into one layer, two layers or a plurality of layers simultaneously. Also, the mordanting polymer of the present invention can be used in admixture with other mordants in the same layer or in separate layers of the same element.

The present invention will now be illustrated in greater detail by reference to the following examples. However, the invention is not to be construed as being limited to these examples. Unless otherwise indicated herein, all parts, percents, ratios and the like are by weight. The x, y and z ratios shown in the examples below are all molar ratios.

EXAMPLE 1

104 g (1.0 mol) of styrene, 152.5 g (1.0 mol) of chloromethylstyrene, 50 ml of ethyl acetate and 3.0 g of benzoyl peroxide, as a polymerization initiator, were placed in a reaction vessel. The air of the reaction vessel was displaced with nitrogen gas. Then, the components were reacted with each other at a temperature of 70° C. for 8 hours. The reaction product was reprecipitated with methanol and dried in vacuo. The yield was 223 g (87.0%), and the viscosity number was 0.15 (measured at 30° C. in a 1% acetone solution). The structural formula of the product is represented by the following general formula:

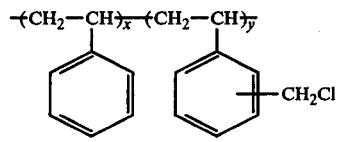

x : y = 50 : 50

EXAMPLES 2 TO 7

Samples having x:y ratios of 80:20 (Example 2), 70:30 (Example 3), 60:40 (Example 4), 40:60 (Example 5), 30:70 (Example 6) and 0:100 (Example 7), respectively, were prepared, using the same procedures as described on Example 1.

EXAMPLE 8

25.6 g of the polymer prepared in Example 1, 39.4 g (0.2 mol) of N-2-ethylhexylpiperidine and 100 ml of dimethylformamide were placed in a reaction vessel, and stirred for 12 hours at 80° C. The reaction product was reprecipitated from water, and dried in vacuo at 60° C. until a constant weight was obtained. The yield was 32.6 g and the viscosity number was 0.60 (at 30° C. as a 0.1% ethanol solution). As the result of elemental analysis, the nitrogen content was 2.81%. The repeating unit of the product is represented by the following structural formula:

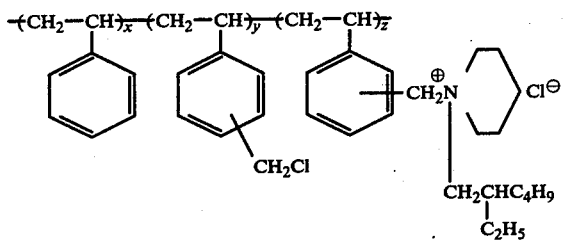

x : y : z = 50 : 10 : 40

EXAMPLES 9 TO 14

Samples Examples 9 to 14 were prepared using the same procedures as described in Example 8 using various polymers prepared in Examples 1, 2, 6 and 7.

EXAMPLE 9

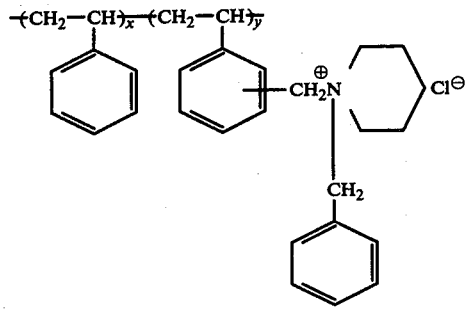

x : y = 80 : 20

EXAMPLE 10

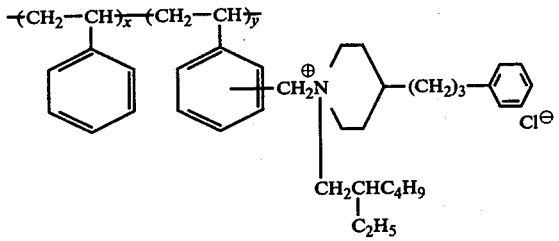

x : y = 50 : 50

EXAMPLE 11

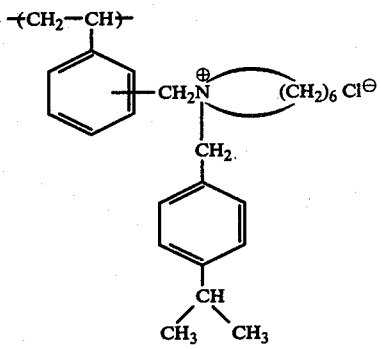

EXAMPLE 12

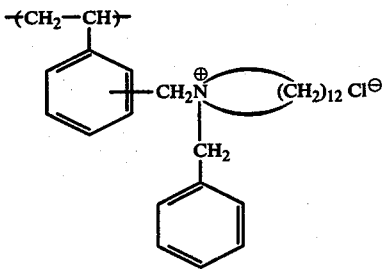

EXAMPLE 13

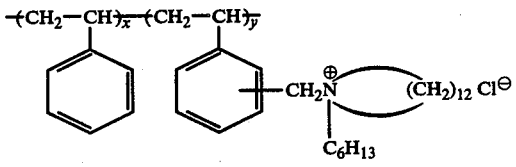

x : y = 50 : 50

EXAMPLE 14

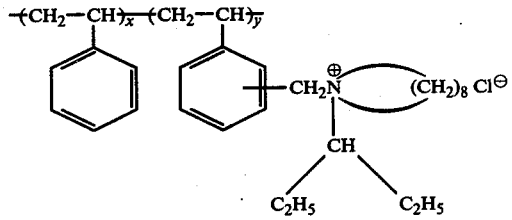

x : y = 30 : 70

EXAMPLE 15

A copolymer was prepared from benzylmethacrylate and chloromethylstyrene (molar ratio of monomer units: 50:50), and then, the following compound was synthesized:

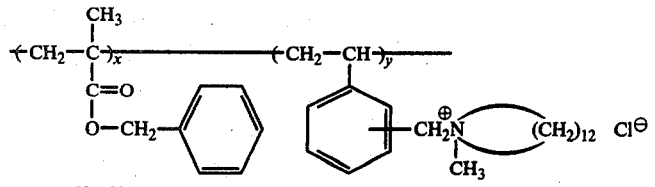

x : y = 50 : 50

Reference Examples 1 and 2

The compounds as disclosed in U.S. Pat. No. 3,898,088 and Japanese Patent Application (OPI) No. 71332/75 (corresponding to U.S. Patent Application Ser. No. 517,561, filed Oct. 24, 1974) were prepared as reference samples using the copolymer prepared in Example 1.

Reference Example 1

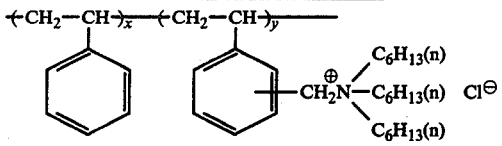

x : y = 50 : 50

Reference Example 2

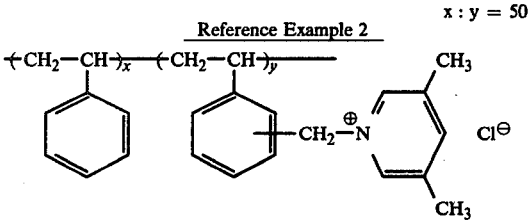

x : y = 50 : 50

EXAMPLE 16

On a polyethylene terephthalate transparent support, a mordant layer of 2.5 g/m$^2$ of one of the mordants listed in Table 1 below and 2.5 g/m$^2$ of gelatin, and a white, light reflecting layer of 20 g/m$^2$ of $TiO_2$ and 2.0 g/m$^2$ of gelatin were provided in sequence thereon. 10 cm$^2$ portions of these samples were immersed in 100 ml of a 0.1 N sodium hydroxide solution containing $1 \times 10^{-3}$ mol/l of a magenta dye having the following structural formula Magenta Dye

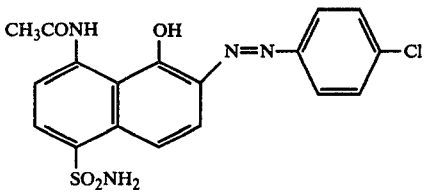

for 5 minutes at room temperature (about 25° C.) and then, the magenta reflection densities were measured from both the support side and the side of the white, light reflecting layer:

The results obtained are shown in Table 1 below.

Table 1

| Mordant Polymer | Magenta Reflecting Density through Support Side | Magenta Reflecting Density from $TiO_2$ Side |
|---|---|---|
| Example 8 | 1.64 | 0.18 |
| Example 9 | 1.58 | 0.18 |

Table 1-continued

| Mordant Polymer | Magenta Reflecting Density through Support Side | Magenta Reflecting Density from $TiO_2$ Side |
|---|---|---|
| Example 10 | 1.59 | 0.17 |
| Example 11 | 1.70 | 0.16 |
| Example 12 | 1.57 | 0.17 |
| Example 13 | 1.73 | 0.15 |
| Example 14 | 1.61 | 0.16 |
| Example 15 | 1.64 | 0.15 |
| Reference Example 2 (Hydrophilic Polymer) | 1.25 | 0.38 |

When the mordant polymer described in Japanese Patent Application (OPI) No. 71332/75 was used, the magenta density in the $TiO_2$ layer was high. The hydrophilic property of the sample of Reference Example 2 seems to be the reason for the high magenta density observed in the $TiO_2$ layer, because the mordant can diffuse from the support side into the $TiO_2$ side due to its hydrophilic property. Therefore, the density of the support side is also low. On the other hand, the mordants of the present invention diffuse into the $TiO_2$ layer to a much lesser extent and that, could contribute to the high density of the support side.

EXAMPLE 17

Each of the above-described mordant polymers and gelatin were coated on a polyethylene terephthalate transparent support at a coverage of 2 g/m$^2$ of both components to prepare an image receiving element. The image receiving elements thus obtained were dyed with a yellow dye having the structural formula described below Yellow Dye

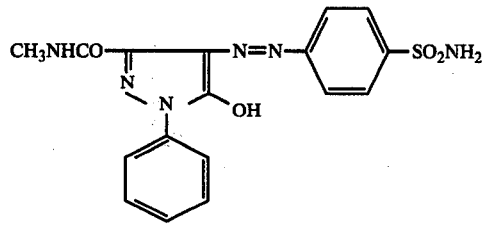

so that the yellow transmitting density became about 1 and then, these dyed films were immersed in a Briton-Robinson buffer solution [Kagaku Binran Kiso-Hen II P 1319, Maruzen Shuppan, Sept. 25 (1966)] in a cell 2 mm deep. After 3 minutes, the transmission absorbing spectra were measured using a Hitach 323 type spectrophotometer. The acid dissociation constants (pKa) of the hydroxy group disposed at the 5-position of the pyrazole ring of the yellow dye present in each of image receiving elements were determined from the dependence of absorption curves upon the hydrogen ion concentrations [using the procedures described in *Lecture of Experimental Chemistry,* Vol. 5, Chap. "Thermal Measurement and Equilibrium", page 470–471, Maruzen Co., Ltd., Tokyo (1958)]. The results obtained are shown in Table 2 below.

In the pH range below the pKa, the yellow dye used becomes difficult to mordant because the electric charge of the dye was lost due to the depression of dissociation in that pH range. Therefore, mordants of the kind which can render the pKa lower exhibit excellent mordanting ability in the pH range corresponding to neutral or weakly acid.

Table 2

| Mordant Polymer | pKa of Yellow Dye |
|---|---|
| Example 8 | 4.3 |
| Example 9 | 4.5 |
| Example 10 | 3.9 |
| Example 11 | 3.8 |
| Example 12 | 3.2 |
| Example 13 | 3.2 |
| Example 14 | 3.6 |
| Example 15 | 3.7 |
| Reference Example 2 | 5.6 |

In order to render the binding of mordant polymers sufficiently strong to dyes, a pKa lower than 4.5 was required. Demordanting phenomena tends to occur in the sample of Reference Example 2 due to a pKa value of 5.6.

It can be seen from the results in Table 2 that the mordant polymers of the present invention have markedly improved mordanting ability even in the case of the sample of Example 9 (which has a pKa of 4.5), compared with the sample of Reference Example 2.

EXAMPLE 18

On a polyethylene terephthalate transparent support, the following 12 layers were coated in sequence to prepare a light sensitive element.

Layer (1)

A mordant layer comprising 3.0 g/m$^2$ of the mordant polymer of the present invention and 3.0 g/m$^2$ of gelatin.

Layer (2)

A white, light-reflecting layer comprising 20 g/m$^2$ of titanium oxide and 2.0 g/m$^2$ of gelatin.

Layer (3)

A light intercepting layer comprising 2.3 g/m$^2$ of carbon black and 3.1 g/m$^2$ of gelatin.

Layer (4)

A cyan dye-providing layer comprising 0.96 g/m$^2$ of a cyan dye image-providing material having the following structural formula Cyan Dye Image-Providing Material

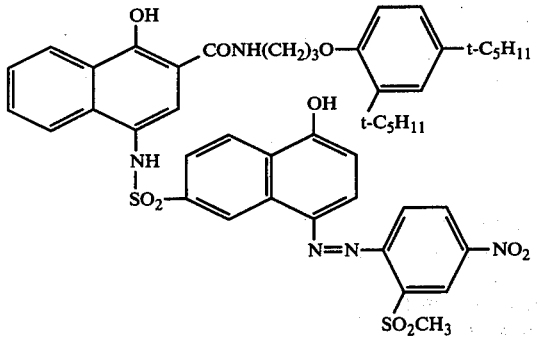

1.6 g/m$^2$ of N,N-diethyllaurylamide in which 0.03 g/m$^2$ of 5-di-t-butylhydroquinone was dissolved, and 1.5 g/m$^2$ of gelatin.

Layer (5)

A red-sensitive silver halide emulsion layer comprising a silver iodobromide direct reversal emulsion having high internal sensitivity, but low surface sensitivity, which contained 1.9 g/m$^2$ of silver and was spectrally sensitized in the wavelength region of red light [which corresponds to the emulsion prepared in Example 1 of Japanese Patent Application No. 79893/75 (corresponding to U.S. Patent Application Ser. No. 700,365, filed June 6, 1974) and now U.S. Pat. No. 4,094,683], 0.040 g/m$^2$ of 3-(2-formylethyl)-2-methylbenzothiazolium bromide and 1.4 g/m$^2$ of gelatin.

Layer (6)

An interlayer comprising 3.3 g/m$^2$ of gelatin, 0.03 g/m$^2$ of sodium hydrogen sulfite and 1.2 g/m$^2$ of 2,5-di-t-octyl-hydroquinone dissolved in both 1.9 g/m$^2$ of tricresyl phosphate and 0.77 g/m$^2$ of dibutyl phthalate.

(Layer (7)

A magenta dye-providing layer comprising 1.5 g/m$^2$ of gelatin, 1.5 g/m$^2$ of N,N-diethyllaurylamide in which 0.89 g/m$^2$ of a magenta dye image-providing material having the following structural formula Magenta Dye Image-Providing Material

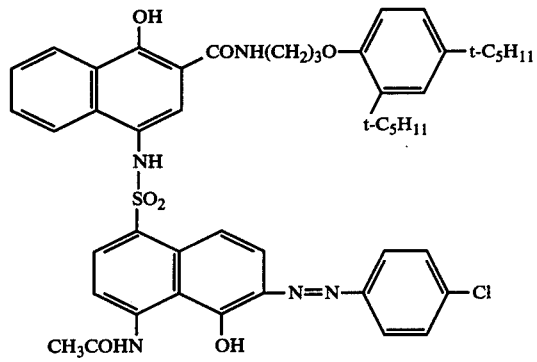

and 0.030 g/m$^2$ of 2,5-di-t-butylhydroquinone were dissolved.

Layer (8)

A green-sensitive emulsion layer comprising a silver iodobromide direct reversal emulsion having high internal sensitivity, but low surface sensitivity, which contained 1.4 g/m$^2$ of silver and was spectrally sensitized in the wavelength region of green light ( which corresponded to the emulsion prepared in Example 1 of Japanese Patent Application No. 79893/75), 0.010 g/m$^2$ of 3-(2-formylethyl)-2-methylbenzothiazolium bromide and 1.0 g/m$^2$ of gelatin.

Layer (9)

An interlayer comprising 3.7 g/m$^2$ of gelatin, 0.023 g/m$^2$ of sodium hydrogen sulfite, and 0.94 g/m$^2$ of 2,5-di-t-octylhydroquinone dissolved in a mixed solvent of 1.5 g/m$^2$ of tricresyl phosphate and 0.61 g/m$^2$ of dibutyl phthalate.

Layer (10)

An yellow dye-providing layer comprising 2.1 g/m$^2$ of gelatin, and 2.5 g/m$^2$ of N,N-diethyllaurylamide in which both 1.5 g/m$^2$ of a yellow dye image-providing material having the following formula Yellow Dye Image-Providing Material

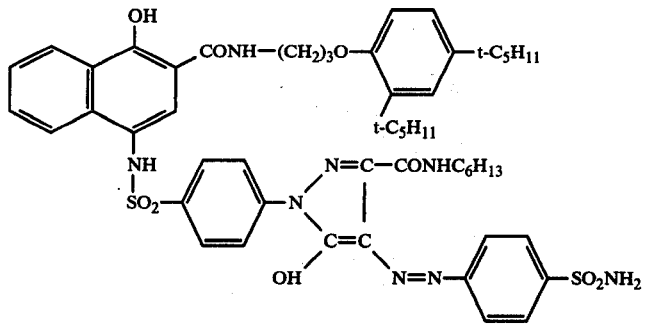

and 0.042 g/m$^2$ of 2,5-di-t-butylhydroquinone were dissolved.

Layer (11)

A blue-sensitive emulsion layer comprising a silver iodobromide direct reversal emulsion having high internal sensitivity, but low surface sensitivity, which contained 2.2 g/m$^2$ of silver and was spectrally sensitized in the wavelength region of blue light (which corresponded to the emulsion prepared in Example 1 of Japanese Patent Application No. 79893/75), 0.014 g/m$^2$ of 3-(2-formylethyl)-2-methylbenzothiazolium bromide and 1.7 g/m$^2$ of gelatin.

Layer (12)

A protective layer comprising 0.95 g/m$^2$ of gelatin.

A processing solution of the following composition was spread in a layer form between the cover element prepared in the following manner and the above-described light sensitive element to obtain the results set forth below.

Cover Element

On a polyethylene terephthalate support, a neutralizing acid polymer layer comprising 15 g/m$^2$ of polyacrylic acid [wherein a 10% by weight aqueous solution possessing a viscosity of about 1000 cp (25° C.) was employed], a neutralization timing layer comprising 3.8 g/m$^2$ of cellulose acetate (capable of producing acetic acid by hydrolysis, wherein 100 g of the cellulose acetate would produce 39.4 g of acetic acid) and 0.2 g/m$^2$ of a styrene-maleic anhydride copolymer (molar ratio of styrene to maleic anhydride = about 60:40; and molecular weight = about 50,000) were coated in sequence.

| Processing Solution | |
|---|---|
| 5-Methylbenzotriazole | 1 g |
| N-Methyl-p-aminophenol Sulfate | 0.5 g |
| N,N-Diethyl-p-aminophenol Hydrochloride | 2 g |
| Sodium Hydrogen Sulfite | 1 g |
| Benzyl Alcohol | 10 ml |
| Xylidene Diol | 25 g |
| Hydroxyethyl Cellulose | 50 g |
| Carbon Black | 30 g |
| Sodium Hydroxide | 20 g |
| Water to make | 1 l |

Table 3

| Mordant Polymer | Reflection Density After One Hour | | Reflection Density After One Week | |
|---|---|---|---|---|
| | Maximum | Minimum | Maximum | Minimum |
| Example 9 | | | | |
| Yellow Density | 1.74 | 0.33 | 1.71 | 0.32 |
| Magenta " | 1.45 | 0.29 | 1.46 | 0.28 |
| Cyan " | 2.00 | 0.35 | 1.99 | 0.32 |
| Example 10 | | | | |
| Yellow Density | 1.78 | 0.31 | 1.76 | 0.30 |

Table 3-continued

| Mordant Polymer | Reflection Density After One Hour | | Reflection Density After One Week | |
|---|---|---|---|---|
| | Maximum | Minimum | Maximum | Minimum |
| Magenta " | 1.50 | 0.30 | 1.50 | 0.29 |
| Cyan " | 2.03 | 0.34 | 2.01 | 0.31 |
| Example 12 | | | | |
| Yellow Density | 1.85 | 0.29 | 1.77 | 0.30 |
| Magenta " | 1.53 | 0.27 | 1.51 | 0.28 |
| Cyan " | 2.05 | 0.33 | 2.03 | 0.30 |
| Example 13 | | | | |
| Yellow Density | 1.82 | 0.31 | 1.79 | 0.32 |
| Magenta " | 1.54 | 0.29 | 1.50 | 0.30 |
| Cyan " | 2.03 | 0.32 | 2.01 | 0.31 |
| Example 15 | | | | |
| Yellow Density | 1.80 | 0.33 | 1.79 | 0.29 |
| Magenta " | 1.51 | 0.31 | 1.52 | 0.32 |
| Cyan " | 2.01 | 0.29 | 2.00 | 0.29 |
| Reference Example 1 | | | | |
| Yellow Density | 1.85 | 0.33 | 1.80 | 0.34 |
| Magenta " | 1.54 | 0.34 | 1.74 | 0.31 |
| Cyan " | 2.04 | 0.35 | 2.33 | 0.36 |

It can be seen from the results of Table 3 that the mordant polymers of the present invention exhibit excellent mordanting ability to provide high reflection densities, do not cause a reduction in the maximum densities (i.e., a demordanting phenomena does not occur even after one week) and also do not cause the after transfer phenomena to occur, while although the reflection density of the sample of Reference Example 1 after one hour is high enough to exhibit an excellent mordanting effect, the increase in the maximum reflection densities after one week by 0.20 and 0.29 with respect to the cyan density and the magenta density, respectively, took place to result in the loss of color balance. Thus, the mordant polymers of the present invention have superior mordanting ability and do not cause the after transfer phenomena to occur, while the sample of Reference Example 1 causes the after transfer phenomena to occur to a serious extent.

While the invention has been described in detail and with reference to specific embodiments thereof, it will be apparent to one skilled in the art that various changes and modifications can be made therein without departing from the spirit and scope thereof.

What is claimed is:

1. A diffusion-transfer, integral negative image-receiving, photographic element comprising a support having thereon at least one layer containing a silver halide photographic emulsion associated with a dye image-providing material which is capable of providing an acidic and diffusible dye or a precursor thereof and at least one hydrophilic colloid layer containing a polymer in an amount of at least 10% by weight based on the weight of the hydrophilic colloid used therein with repeating units in which at least 20 mol % of the repeating units are represented by the following general formula (I)

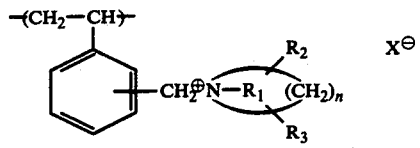

(I)

wherein $R_1$ represents an alkyl group containing 1 to 12 carbon atoms, an aralkyl group, an aryl group or an allyl group; $R_2$ and $R_3$, which can be the same or different, each represents a hydrogen atom, an alkyl group, an aralkyl group, an aryl group or an allyl group, where the total number of carbon atoms present in the main chain and/or ring of $R_2$ and $R_3$ is less than 16; n represents an integer from 2 to 20; and $X^{\ominus}$ represents an anion.

2. The integral negative image-receiving element of claim 1, wherein the polymer contains at least 35 mol % of the repeating units represented by the general formula (I).

3. The integral negative image-receiving element of claim 1, wherein $R_1$ is an alkyl group or an aralkyl group.

4. The integral negative image-receiving element of claim 1, wherein n is an integer from 5 to 16.

5. A diffusion-transfer, integral negative image-receiving, photographic element comprising a support having thereon at least one layer containing a silver halide photographic emulsion associated with a dye image-providing material which is capable of providing an acidic and diffusible dye or a precursor thereof and at least one hydrophilic colloid layer containing a copolymer in an amount of at least 10% by weight based on the weight of the hydrophilic colloid used therein containing repeating units with (a) at least 20 mol % of the repeating units being units represented by the following formula (I)

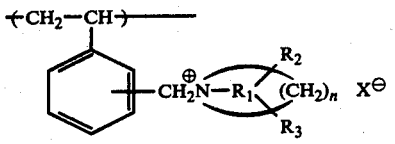

(I)

wherein $R_1$ represents an alkyl group containing 1 to 12 carbon atoms, an aralkyl group, an aryl group or an allyl group; $R_2$ and $R_3$, which can be the same or different, each represents a hydrogen atom, an alkyl group, an aralkyl group, an aryl group or an allyl group, where the total number of carbon atoms present in the main chain and/or ring of $R_2$ and $R_3$ is less than 16; n represents an integer from 2 to 20; and $X^{\ominus}$ represents an anion, with (b) repeating units of at least one other $\alpha,\beta$-ethylenically unsaturated monomer.

6. The integral negative image-receiving element of claim 5, wherein the $\alpha,\beta$-ethylenically unsaturated monomer is styrene.

7. The integral negative image-receiving element of claim 5, wherein the $\alpha,\beta$-ethylenically unsaturated monomer is vinyltoluene.

8. The integral negative image-receiving element of claim 5, wherein the polymer contains at least 35 mol % of the repeating units represented by the general formula (I).

9. The integral negative image-receiving element of claim 5, wherein $R_1$ is an alkyl group or an aralkyl group.

10. The integral negative image-receiving element of claim 5, wherein n is an integer from 5 to 16.

11. The integral negative image-receiving element of claim 1, wherein the dye image-providing material is an originally non-mobile dye image-providing material.

12. The integral negative image-receiving element of claim 5, wherein the dye image-providing material is an originally non-mobile dye image-providing material.

* * * * *